US010425724B2

(12) United States Patent
Link et al.

(10) Patent No.: US 10,425,724 B2
(45) Date of Patent: Sep. 24, 2019

(54) INTERPOSER STACK INSIDE A SUBSTRATE FOR A HEARING ASSISTANCE DEVICE

(71) Applicant: Starkey Laboratories, Inc., Eden Prairie, MN (US)

(72) Inventors: Douglas F. Link, Plymouth, MN (US); Ay Vang, Forest Lake, MN (US); Yike Wang, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 97 days.

(21) Appl. No.: 14/612,702

(22) Filed: Feb. 3, 2015

(65) Prior Publication Data

US 2015/0264475 A1 Sep. 17, 2015

Related U.S. Application Data

(60) Provisional application No. 61/952,223, filed on Mar. 13, 2014.

(51) Int. Cl.
*H04R 25/00* (2006.01)
*H04R 3/00* (2006.01)
(Continued)

(52) U.S. Cl.
CPC ..... *H04R 3/00* (2013.01); *H04R 19/005* (2013.01); *H04R 19/04* (2013.01); *H04R 25/00* (2013.01);
(Continued)

(58) Field of Classification Search
CPC .... H04R 19/005; H04R 19/016; H04R 25/02; H04R 25/604; H04R 25/65; H04R 25/658;
(Continued)

(56) References Cited

U.S. PATENT DOCUMENTS 6,133,626 A 10/2000 Hawke et al.
6,287,893 B1 9/2001 Elenius et al.
(Continued)

FOREIGN PATENT DOCUMENTS

EP 1951015 A1 7/2008
EP 2157842 A1 2/2010
(Continued)

OTHER PUBLICATIONS

"European Application Serial No. 15159010.6, Communication pursuant to Rules 70(2) and 70a(2) EPC/Rule 39(1) dated Sep. 21, 2015", 2 pgs.
(Continued)

*Primary Examiner* — Huyen D Le
(74) *Attorney, Agent, or Firm* — Schwegman Lundberg & Woessner, P.A.

(57) ABSTRACT

Disclosed herein, among other things, are systems and methods for improved circuit design for hearing assistance devices. One aspect of the present subject matter includes a hearing assistance device configured to compensate for hearing losses of a user. The hearing assistance device includes a substrate and an interposer embedded into the substrate to form a system in package module. According to various embodiments, the interposer includes one or more integrated circuits (ICs) on the interposer, the one or more ICs configured to provide electronics for the hearing assistance device.

12 Claims, 3 Drawing Sheets

(51) Int. Cl.
*H04R 19/04* (2006.01)
*H04R 19/00* (2006.01)

(52) U.S. Cl.
CPC ..... *H04R 25/60* (2013.01); *H04R 2201/003* (2013.01); *H04R 2225/021* (2013.01); *H04R 2225/023* (2013.01); *H04R 2225/025* (2013.01)

(58) Field of Classification Search
CPC ..... H04R 2201/003; H04R 2225/021; H04R 2225/023; H04R 2225/025; H04R 1/04; H05R 19/04
USPC ..... 381/174, 175, 191, 322, 324, 328, 330, 381/380; 29/831, 832; 257/416; 438/53
See application file for complete search history.

(56) References Cited

U.S. PATENT DOCUMENTS

| | | | | |
|---|---|---|---|---|
| 6,441,487 | B2 | 8/2002 | Elenius et al. | |
| 6,522,762 | B1 * | 2/2003 | Mullenborn | H04R 19/005 367/181 |
| 6,750,135 | B2 | 6/2004 | Elenius et al. | |
| 6,914,200 | B2 | 7/2005 | Higuchi et al. | |
| 6,919,508 | B2 | 7/2005 | Forcier | |
| 7,011,988 | B2 | 3/2006 | Forcier et al. | |
| 7,057,292 | B1 | 6/2006 | Elenius et al. | |
| 7,122,746 | B2 | 10/2006 | Higuchi et al. | |
| 7,142,682 | B2 * | 11/2006 | Mullenborn | H04R 19/005 381/322 |
| 7,382,056 | B2 * | 6/2008 | Chiu | H01L 23/49822 257/701 |
| 7,973,418 | B2 | 7/2011 | Alvarado et al. | |
| 8,058,163 | B2 | 11/2011 | Reche et al. | |
| 8,143,722 | B2 | 3/2012 | Curtis et al. | |
| 8,188,606 | B2 | 5/2012 | Alvarado et al. | |
| 8,482,110 | B2 | 7/2013 | Fjelstad | |
| 8,891,796 | B2 * | 11/2014 | van Halteren | H04R 25/02 381/330 |
| 2003/0168738 | A1 | 9/2003 | Kabadi et al. | |
| 2004/0118594 | A1 * | 6/2004 | Dory | H05K 3/005 174/250 |
| 2007/0108583 | A1 | 5/2007 | Shim et al. | |
| 2010/0081236 | A1 | 4/2010 | Yang et al. | |
| 2010/0158296 | A1 | 6/2010 | Dumas et al. | |
| 2011/0200475 | A1 * | 8/2011 | Hirata | F01C 17/063 418/55.1 |
| 2012/0087521 | A1 * | 4/2012 | Delaus | B81C 1/00238 381/174 |
| 2013/0284501 | A1 | 10/2013 | McConnell et al. | |
| 2013/0343564 | A1 | 12/2013 | Darlington | |
| 2014/0064546 | A1 * | 3/2014 | Szczech | H04R 1/04 381/361 |
| 2014/0070380 | A1 | 3/2014 | Chiu | |
| 2014/0103464 | A1 * | 4/2014 | Bolognia | H04R 1/04 257/416 |
| 2014/0159247 | A1 | 6/2014 | Lyne et al. | |

FOREIGN PATENT DOCUMENTS

| | | | |
|---|---|---|---|
| EP | 2290687 | A1 | 3/2011 |
| WO | WO-2007043639 | A1 | 4/2007 |
| WO | WO-2010075331 | A1 | 7/2010 |

OTHER PUBLICATIONS

"European Application Serial No. 15159010.6, Extended European Search Report dated Jul. 8, 2015", 6 pgs.
"Robust, Simplified and Solder-Free Assembly Processing of Electronics Products", Verdant Electronics, Inc., Sunnyvale, CA., 24 pgs.
Ebefors, Thorbjorn, et al., "Recent Results Using MET—via TSV Interposer Technology as TMV Element in Wafer Level Through Mold via Packaging of CMOS Biosensors", Silex Microsystems AB, 8 pgs.
Garrou, Phil, et al., "Intel Announces "New Interconnect" for 14nm", Solid State Technology, http://semimd.com/blog/2014/09/02/intel-announces-new-interconnect-for-14nm/, (Accessed Oct. 28, 2015), 5 pgs.
Neuhaus, Herbert J., et al., "Changing Paradigms in Interconnect, Packaging, and Assembly", TechLead Corporation, Portland, OR, USA, (Apr. 17, 2013), 6 pgs.
Tong, Ho-Ming, et al., "Advanced Flip Chip Packaging", Springer, (2013), 3 pgs.
"European Application Serial No. 15159010.6, Communication pursuant to Article 94(3) dated Apr. 26, 2016", 5 pgs.
"European Application Serial No. 15159010.6, Response filed Mar. 16, 2016 to Extended European Search Report dated Jul. 8, 2015", 10 pgs.
"European Application Serial No. 15159010.6, Response filed Nov. 7, 2016 to Communication pursuant to Article 94(3) dated Apr. 26, 2016", 8 pgs.
"European Application Serial No. 18158937.5, Extended European Search Report dated Jun. 14, 2018", 6 pgs.
"10th International Conference and Exhibition on Device Packaging Technical Program", 2014 IMAPS—International Microelectronics and Packaging Society, [Online]. [Accessed Nov. 26, 2018]. Retrieved from the Internet: <URL: http://www.imaps.org/programs/devicepackaging2014.htm >, (2014), 10 pgs.
"8th Annual International Wafer-Level Packaging Conference & Tabletop Exhibition 2011", IWLPC 2011, (Oct. 2011), 5 pgs.
"European Application Serial No. 15159010.6, Opposition Brief filed Dec. 6, 2018", 34 pgs.
Cheng, Ren-Shin, et al., "Process Characteristics of a 2.50 Silicon Module Using Embedded Technology as a Feasible Solution for System Integration and Thinner Form-Factor", 2013 IEEE; Electronic Components & Technology Conference; 1975-1979, (2013), 5 pgs.
Dzarnoski, John, et al., "Embedding Active and Passive Devices in Medical Electronics", Additional Conferences—iMAPSource Microelectronis Research Portal, [Online]. [Accessed Nov. 27, 2018]. Retrieved from the Internet: <URL: http://imapsource.org/toc/apap/2014/DPC>, (2018), 9 pgs.
Dzarnoski, John, et al., "Ultra Small Hearing Aid Electronic Packaging Enabled by Chip-In-Flex", 2014 IEEE; Electronic Components & Technology Conference; 157-164, (2014), 8 pgs.
Itoi, Kazuhisa, et al., "Laminate Based Fan-Out Embedded Die Packaging Using Polyimide Multilayer Wiring Boards", IWLPC (Wafer-Level Packaging) Conference Proceedings, (2011), 7 pgs.
Johansson, Susie, et al., "Embedding Active and Passive Devices in Medical Electronics", IMAPS 2014 Device Packaging Conference Presentation, (2014), 29 pgs.

* cited by examiner

INTERPOSER STACK INSIDE A SUBSTRATE FOR A HEARING ASSISTANCE DEVICE

CLAIM OF PRIORITY AND INCORPORATION BY REFERENCE

The present application claims the benefit under 35 U.S.C. § 119(e) of U.S. Provisional Patent Application 61/952,223, filed Mar. 13, 2014, the disclosure of which is hereby incorporated by reference herein in its entirety.

TECHNICAL FIELD

This document relates generally to hearing assistance systems and more particularly to methods and apparatus for an interposer stack inside a substrate for a hearing assistance device.

BACKGROUND

Modern hearing assistance devices, such as hearing aids, are electronic instruments worn in or around the ear that compensate for hearing losses of hearing-impaired people by specially amplifying sound. Hearing aids typically include a housing or shell with internal components such as a signal processor, a microphone and a receiver housed in a receiver case. The housing or shell of a hearing assistance device has a size limitation based on the application. Specifically, devices that include an in-the-ear portion have housings that are constrained by the geometry of the inner ear of the wearer.

Accordingly, there is a need in the art for improved systems and methods for efficient circuit design to reduce size of a hearing assistance device.

SUMMARY

Disclosed herein, among other things, are systems and methods for improved circuit design for hearing assistance devices. One aspect of the present subject matter includes a hearing assistance device configured to compensate for hearing losses of a user. The hearing assistance device includes a substrate and an interposer embedded into the substrate to form a system in package module. According to various embodiments, the interposer includes one or more integrated circuits (ICs) on the interposer, the one or more ICs configured to provide electronics for the hearing assistance device.

One aspect of the present subject matter includes a hearing assistance device method. The method includes combining one or more integrated circuits (ICs) on an interposer, and embedding the interposer into a substrate to form a system in package module. According to various embodiments, the one or more ICs are configured to provide electronics for a hearing assistance device.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1A:
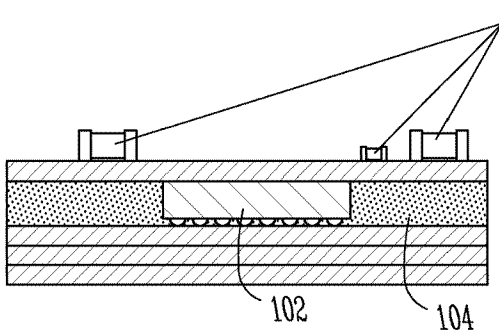
FIG. 1A illustrates a side view of a circuit substrate for a hearing assistance device.
Figure 1A:
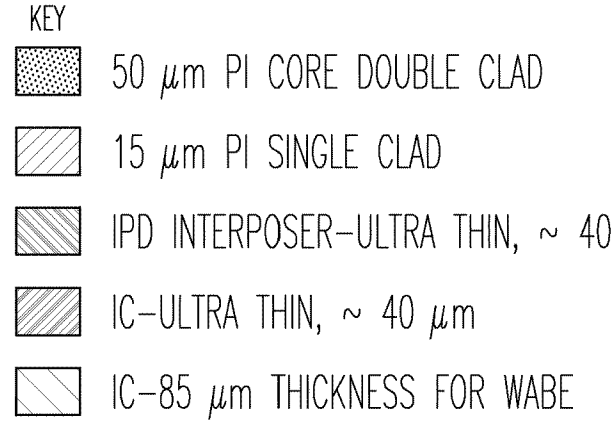

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present detailed description will discuss hearing assistance devices using the example of hearing aids. Hearing aids are only one type of hearing assistance device. Other hearing assistance devices include, but are not limited to, those in this document. It is understood that their use in the description is intended to demonstrate the present subject matter, but not in a limited or exclusive or exhaustive sense. One of skill in the art will understand that the present subject matter can be used for a variety of integrated circuit technologies and applications, including but not limited to hearing assistance applications such as hearing instruments, personal amplification devices and accessories.

Hearing aids typically include a housing or shell with internal components such as a signal processor, a microphone and a receiver housed in a receiver case. The housing or shell of a hearing assistance device has a size limitation based on the application. Specifically, devices that include an in-the-ear portion have housings that are constrained by the geometry of the inner ear of the wearer. Smaller device components and circuit packages are needed. Modern and future hearing aids use more and more ICs, such as separate digital, analog, and power management IC's, one or more nonvolatile memory (NVM) IC's, and more associated passive components. Thus, there is a need to pack more performance, and therefore more components, into next generation hearing aids.

Various current hearing aid microelectronic circuits use flip chip on flex (FCOF) technology, thick film technology, and surface-mount technology (SMT) on a rigid printed circuit board (PCB) for microelectronic packaging. Thick film technology is limited by three main factors: trace/space size, number of layers, and substrate thickness. Previously the smallest trace/space design rule is 5 mils (125 um), 3 layers, and a printed ceramic thickness of 17 mils. Thick film is generally considered to be lower cost compared to FCOF, but FCOF offers the advantage of miniaturization over thick film and the more traditional SMT on rigid PCB technology. While the more expensive FCOF circuits tend to be smaller than thick film circuits, they are also more susceptible to mechanical damage due to the exposed flip chip die. Methods to further protect the exposed die, such as backside die coating, require further size increases and higher cost.

Additional previous approaches include embedding die within a substrate using multilayer stacks (such as wafer and board level device embedded or WABE), redistributed chip packages (RCP) and fan-in/fan-out technology. However, these previous approaches have drawbacks. Some use side-by-side die placement on an outer surface that increases package area. Others embed die within a substrate which adds to the core layer thickness and is limited to only two die per package.

The present subject matter combines one or more chips (ICs) on an interposer, or interposer/IPD (integrated passive device), and embeds the resulting interposer stack into a substrate to form a SiP (system in package) module. Thus, the present subject matter provides for an increased number of IC chips in a smaller microelectronic package for hearing assistance devices. A modular approach is used that includes passive components formed within an interposer and then embedding the interposer into a substrate, thus taking up less volume in various embodiments. In addition, multiple die can be combined in a substrate of a single package in various embodiments.

Disclosed herein, among other things, are systems and methods for improved circuit design for hearing assistance devices. One aspect of the present subject matter includes a hearing assistance device configured to compensate for hearing losses of a user. The hearing assistance device includes a substrate and an interposer embedded into the substrate to form a system in package module. According to various embodiments, the interposer includes one or more ICs on the interposer, the one or more ICs configured to provide electronics for the hearing assistance device. One aspect of the present subject matter includes a hearing assistance device method. The method includes combining one or more ICs on an interposer, and embedding the interposer into a substrate to form a system in package module. According to various embodiments, the one or more ICs are configured to provide electronics for a hearing assistance device.

According to various embodiments, the interposer is made of silicon, glass, or organic material. Other types of interposers can be used without departing from the scope of the present subject matter. The interposer is manufactured in wafer or array form and may contain IPD (integrated passive device), TSV (through silicon via), and RDL (redistribution layer) elements, in various embodiments. Silicon IPD interposers with RDL and IPD are used for the present subject matter, in one embodiment.

One or more chips are attached to the silicon interposer wafer using COW (chip on wafer) or similar technology, in an embodiment. Thinning of the stacked chip and interposer can be done before or after COW depending on which embedded technology is used, in various embodiments. For using the present subject matter with WABE technology, the stack is thinned to 85 microns in an embodiment. The stacked interposer wafer is then diced and the interposer stack is handled in similar fashion to a single flip chip and embedded into a package substrate, in various embodiments. FIGS. 1B, 2B and 3B illustrate several embodiments of the present subject matter and with comparisons to previous technology in FIGS. 1A, 2A and 3A. The present subject matter can also be implemented using other three-dimensional packaging technologies, such RCP in various embodiments.

Figure 1B:
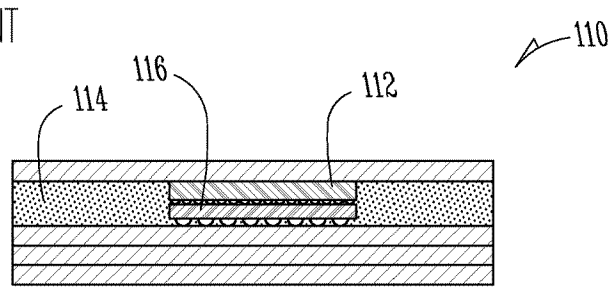
FIG. 1B illustrates a side view of a circuit substrate for hearing assistance devices including an interposer and showing reduced size benefits compared to FIG. 1A, according to various embodiments of the present subject matter.
Figure 1B:
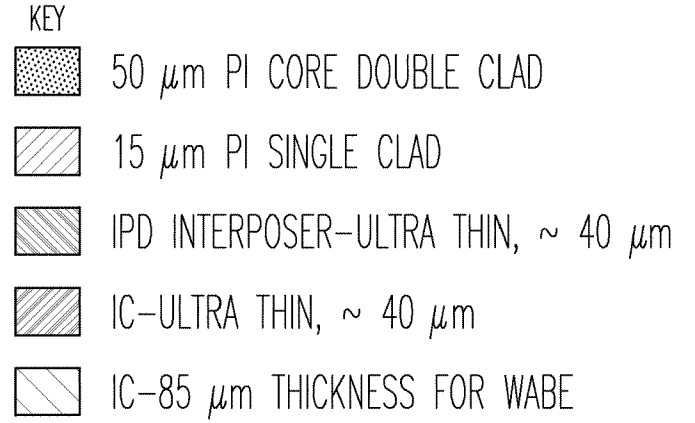
Figure 2B:
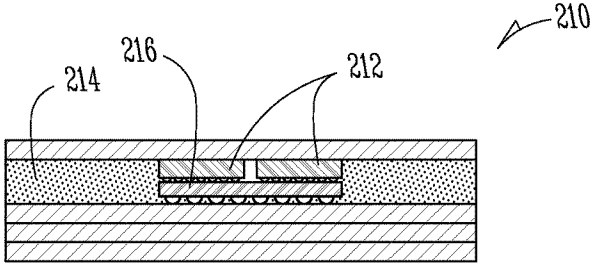
FIG. 2B illustrates a side view of a circuit substrate for hearing assistance devices including an interposer and showing reduced size benefits compared to FIG. 2A, according to various embodiments of the present subject matter.
Figure 2B:
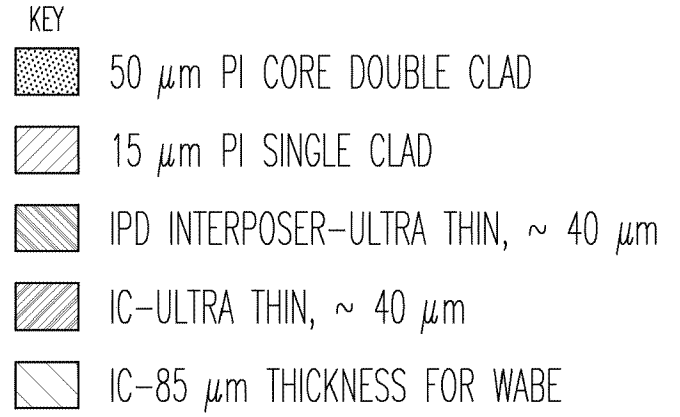

FIG. 1A illustrates a side view of a previous circuit substrate for a hearing assistance device. The substrate 104 includes an embedded IC 102. FIG. 1B illustrates a side view of a circuit substrate for hearing assistance devices including an interposer and showing reduced size benefits compared to FIG. 1A, according to various embodiments of the present subject matter. An interposer SiP 110 module includes an IC 112 plus passives embedded in an interposer 116 within substrate 114. The embodiment shows that additional circuitry can occupy the same or smaller space using the present subject matter.

Figure 2A:
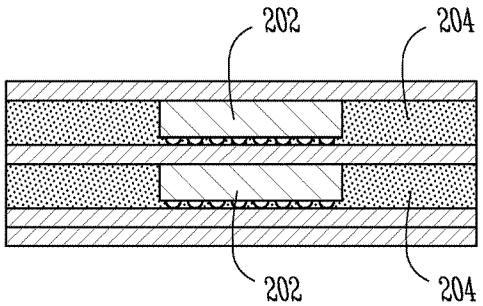
FIG. 2A illustrates a side view of a circuit substrate for a hearing assistance device.
Figure 2A:
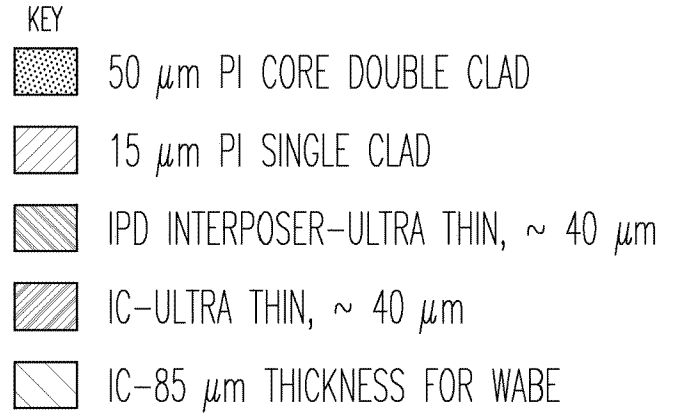
Figure 3B:
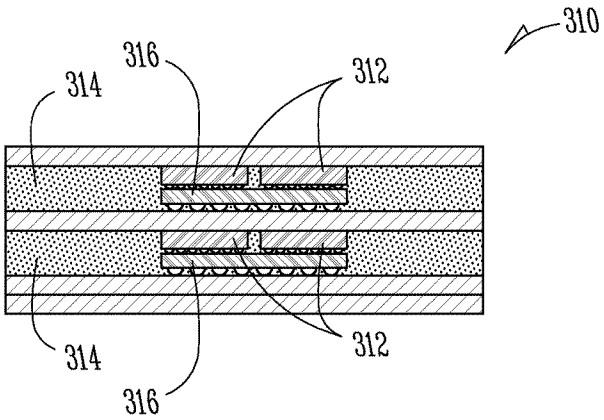
FIG. 3B illustrates a side view of a circuit substrate for hearing assistance devices including an interposer and showing reduced size benefits compared to FIG. 3A, according to various embodiments of the present subject matter.
Figure 3B:
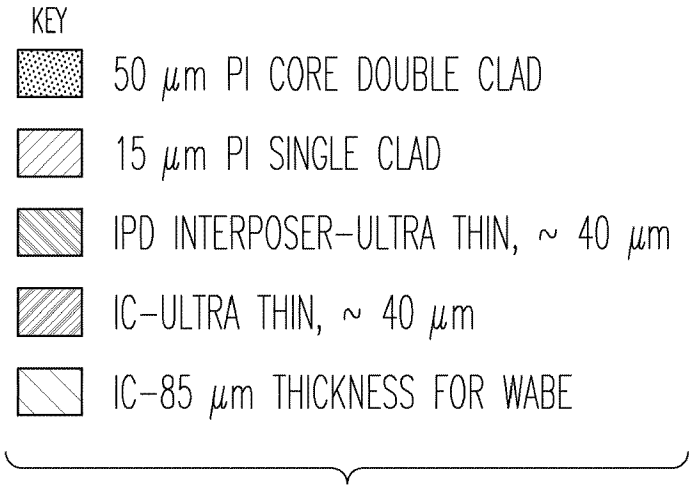

FIG. 2A illustrates a side view of a previous circuit substrate for a hearing assistance device. The substrate 204 includes two embedded ICs 202. FIG. 2B illustrates a side view of a circuit substrate for hearing assistance devices including an interposer and showing reduced size benefits compared to FIG. 2A, according to various embodiments of the present subject matter. An interposer SiP 210 module includes two ICs 212 plus passives embedded in an interposer 216 within substrate 214. The embodiment shows that additional circuitry can occupy a smaller space using the present subject matter.

Figure 3A:
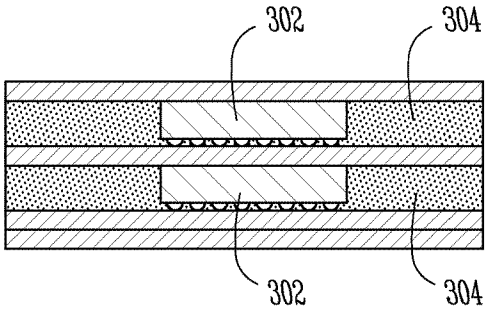
FIG. 3A illustrates a side view of a circuit substrate for a hearing assistance device.
Figure 3A:
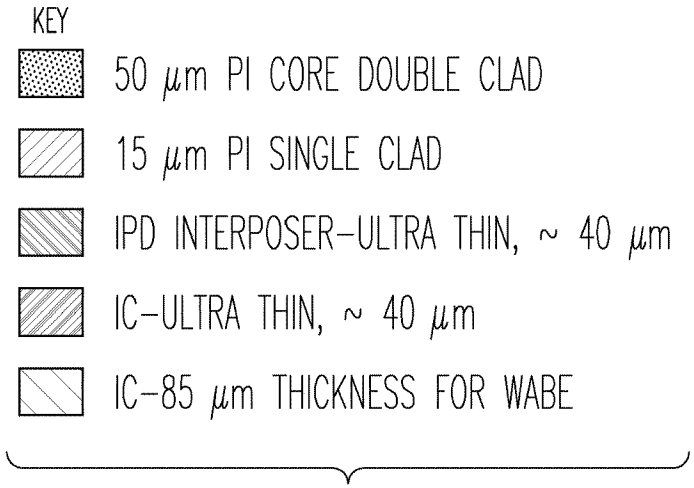

FIG. 3A illustrates a side view of a previous circuit substrate for a hearing assistance device. The substrate 304 includes two embedded ICs 302. FIG. 3B illustrates a side view of a circuit substrate for hearing assistance devices including an interposer and showing reduced size benefits compared to FIG. 3A, according to various embodiments of the present subject matter. An interposer SiP 310 module includes four ICs 312 plus passives embedded in interposers 316 within substrate 314. The embodiment shows that additional circuitry can occupy the same or smaller space using the present subject matter.

The present subject matter provides embedded interposer packaging technology providing for manufacture of smaller, higher density microelectronic assemblies and therefore smaller devices. In addition, the present subject matter miniaturizes hearing aid microelectronics and enables a more modular approach to system design, in various embodiments. In various embodiments, the present subject matter provides for attachment of one or more active flip chip IC's to a passive silicon interposer and then embedding that stack inside a substrate for the purposes of providing IC fan out electrical connection of the die to other components and reducing size. The IC is mounted onto an interposer permanently, using either solder or direct copper-copper bond or related metallurgy, with the stack embedded inside a motherboard for space savings, in various embodiments. Mounting an IC directly onto the interposer minimizes both electrical trace routing length and size. A stack including at least one interposer die with at least one flip chip die attached directly to it and embedded into the substrate of a microelectronic package is used, in various embodiments.

The present subject matter provides for hearing aid modules for all hearing assistance device products, such as: BTE, RIC, and custom ITE hearing instruments. Examples are shown in the accompanying figures. In various embodiments, the ICs include a DSP IC. Passive components include inductors (L) and/or capacitors (C), in various embodiments. In an embodiment, the ICs include an EEPROM. Various types of ICs, such as DSP dies or chips, can be used without departing from the scope of the present subject matter. The present subject matter can be used for any type of hearing aid IC-based module or modules (die), such as a power management IC module, a DSP IC module, a memory IC module, a radio IC module, other feature module, or combination of modules. In addition, the packaging solutions provided herein can be used for personal amplification devices and accessories or any related application that requires miniaturization. The present subject matter provides for the manufacture of smaller, higher density microelectronic devices and therefore smaller hearing aids. In various embodiments, the package of the present subject matter is more mechanically robust than previous technology, as no ICs are exposed.

It is understood that variations in combinations of components may be employed without departing from the scope of the present subject matter. Hearing assistance devices typically include an enclosure or housing, a microphone, hearing assistance device electronics including processing electronics, and a speaker or receiver. It is understood that in various embodiments the microphone is optional. It is understood that in various embodiments the receiver is optional. Antenna configurations may vary and may be included within an enclosure for the electronics or be external to an enclosure for the electronics. Thus, the examples set forth herein are intended to be demonstrative and not a limiting or exhaustive depiction of variations.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the user.

It is understood that the hearing aids referenced in this patent application include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, audio decoding, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), invisible-in-canal (IIC) or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance device, comprising:

a substrate; and an interposer embedded into the substrate to form a system in package module sized to fit in an ear of a wearer, wherein the interposer includes one or more active flip chip integrated circuits (ICs) and one or more integrated passive devices attached to the interposer prior to embedding, the one or more ICs configured to provide electronics for the hearing assistance device.

2. The hearing assistance device of claim 1, wherein the interposer includes silicon.

3. The hearing assistance device of claim 1, wherein the interposer includes glass.

4. The hearing assistance device of claim 1, wherein the interposer includes an organic material.

5. The hearing assistance device of claim 1, wherein the hearing assistance device includes a cochlear implant.

6. The hearing assistance device of claim 1, wherein the hearing assistance device includes a hearing aid.

7. The hearing assistance device of claim 6, wherein the hearing aid includes an in-the-ear (ITE) hearing aid.

8. The hearing assistance device of claim 6, wherein the hearing aid includes a behind-the-ear (BTE) hearing aid.

9. The hearing assistance device of claim 6, wherein the hearing aid includes an in-the-canal (ITC) hearing aid.

10. The hearing assistance device of claim 6, wherein the hearing aid includes a receiver-in-canal (RIC) hearing aid.

11. The hearing assistance device of claim 6, wherein the hearing aid includes a completely-in-the-canal (CIC) hearing aid.

12. The hearing assistance device of claim 6, wherein the hearing aid includes a receiver-in-the-ear (RITE) hearing aid.

* * * * *